United States Patent [19]

Kronich

[11] Patent Number: 4,856,467

[45] Date of Patent: Aug. 15, 1989

[54] ADJUSTABLE LASH VALVE TRAIN FOR OVERHEAD VALVE ENGINE

[75] Inventor: Peter G. Kronich, Sheboygan, Wis.

[73] Assignee: Tecumseh Products Company, Tecumseh, Mich.

[21] Appl. No.: 196,722

[22] Filed: May 20, 1988

[51] Int. Cl.[4] ..... F01L 1/22; F01L 1/14

[52] U.S. Cl. ..... 123/90.43; 123/90.41; 123/90.61

[58] Field of Search ..... 123/90.41, 90.43, 90.61; 74/519, 559; 384/2

[56] References Cited

U.S. PATENT DOCUMENTS

| | | | |
|---|---|---|---|
| Re. 24,035 | 7/1955 | Leach . | |
| 2,669,981 | 2/1954 | Leach | 74/559 |
| 2,771,866 | 11/1956 | Sampietro . | |
| 3,054,392 | 9/1962 | Thompson | 123/90.61 |
| 3,064,635 | 11/1962 | Rohrbacher | 123/90.41 |
| 3,301,238 | 1/1967 | Hanley | 123/90.41 |
| 3,359,959 | 12/1967 | Rose | 74/519 |
| 3,401,678 | 9/1968 | Rose | 74/519 |
| 3,589,346 | 6/1971 | Warren et al. | 123/90.41 |
| 3,592,174 | 7/1971 | Heidacker | 74/519 |
| 4,601,267 | 7/1986 | Kronich | 123/90.33 |

*Primary Examiner*—Willis R. Wolfe
*Assistant Examiner*—M. Macy
*Attorney, Agent, or Firm*—Albert L. Jeffers; John F. Hoffman

[57] ABSTRACT

An adjustable valve lash train for an overhead valve engine includes a rocker arm stud having a threaded shank received in a correspondingly threaded bore in said cylinder head. The rocker arm stud includes an integral head having a spherically shaped bearing surface on the undersurface thereof in engagement with a correspondingly shaped bearing surface on the rocker arm. The head of the rocker arm stud includes a hexagonally shaped recess in the top surface thereof for receipt of an adjustment tool. A threaded jam nut is received about the threaded shank of the rocker arm stud for selectively locking the threaded shank against rotation with respect to the threaded bore of the cylinder head. A push rod guide plate is sandwiched between the cylinder head and the jam nut adjacent the shank of the rocker arm stud for controlling lateral displacement of a push rod.

12 Claims, 2 Drawing Sheets

ADJUSTABLE LASH VALVE TRAIN FOR OVERHEAD VALVE ENGINE

BACKGROUND OF THE INVENTION

The present invention relates generally to overhead valve internal combustion engines, and more particularly to the valve train of such an engine.

Air cooled overhead valve internal combustion engines have a cylinder head in which the intake and exhaust valves are slidingly mounted and oriented such that the valve stems extend from the valve head in a direction generally away from the top of the cylinder bore. Push rods engaging valve lifters actuated by a cam shaft in the cylinder portion of the engine extend into the cylinder head generally alongside the valve stems. Disposed between each valve stem and corresponding push rod is a rocker arm pivotally mounted on a rocker arm stud connected to the cylinder head. The rocker arm engages the push rod at one end and the top of the valve stem at the other end and serves to translate upper movement of the push rod to a corresponding downward movement of the valve stem.

Prior rocker arm studs are usually fastened at their lower end to the cylinder head either by a tight press-fit into a corresponding bore or by a threading received in a correspondingly threaded bore. The upper end of the rocker arm stud is usually threaded and received loosely through an elongate hole in the bottom of the rocker arm. A separate spherical-surfaced pivot washer is often disposed about the upper threaded end of the rocker stud in engagement with a corresponding spherical bearing surface inside the rocker arm. A locking type of nut is threaded onto the upper end of the rocker arm stud above the spherical pivot washer and is used to adjust the valve lash by moving the rocker arm pivot point upwardly or downwardly by turning the locking nut with respect to the fixed rocker arm stud to a selected position.

In some overhead valve engines a push rod guide plate is sandwiched between the cylinder head and an integral enlargement of the rocker arm stud. The push rod guide plate includes guide tabs disposed on either side of the push rod to control lateral displacement of the push rod in a direction perpendicular to the rocking plane of the rocker arm.

One disadvantage of the prior art construction of the rocker arm and rocker arm stud is that a significant amount of space is taken up by the locking nut at the top end of the rocker arm stud. Where the locking nut is recessed between the sidewalls of an open-topped stamped rocker arm, sufficient clearance must be provided between the locking nut and the sidewall for an adjustment wrench. In addition, the height of the rocker arm stud must extend above the spherical pivot washer so that the upper threads of the rocker arm stud can be engaged by the locking nut. These two factors increase the width of the rocker arms and the overall height of the valve mechanism with respect to the head gasket surface.

SUMMARY OF THE INVENTION

The present invention involves an improved rocker arm stud cooperating with a rocker arm which permits a compact rocker arm and valve train construction and provides for ease of valve lash adjustment without disturbing the push rod guide plate. The rocker arm stud is an integral piece having a threaded shank threadedly received in the cylinder head and a head portion having an integral bearing surface in engagement with a bearing surface on the rocker arm. The head of the rocker arm stud includes tool engaging means recessed in the top surface thereof for engaging a tool to rotate the rocker arm stud for valve lash adjustment.

The present invention provides an improvement over the prior art in that the bearing surface associated with the rocker arm stud is formed integrally with the rocker arm stud which eliminates separate bearing washer. The valve lash is adjusted by rotating the rocker arm stud such that the threaded shank thereof moves into or out of the cylinder head at the lower end of the rocker arm stud. The overall height of the valve train is reduced by eliminating the adjustable lock nut at the top of the rocker arm stud as used in the prior art for valve lash adjustment. In contrast, locking means are provided at the lower end of the rocker arm stud for both holding the push rod guide plate in place and for restraining the rocker arm stud against rotation once the valve lash has been adjusted. Provision of tool engaging means recessed in the top surface of the head of the rocker arm stud permits valve lash adjustment with a tool (such as an Allen wrench) having a width less than the head of the rocker arm stud. Consequently, there is no need to provide clearance between the sides of the rocker arm and the rocker arm stud head to accommodate a bulky wrench.

The invention, in one form thereof, provides an adjustable lash valve train in combination with an overhead valve internal combustion engine having a cylinder head, a valve reciprocally mounted in the cylinder head, and a push rod. A rocker arm is disposed for transmitting motion of the push rod to the valve, with the rocker arm including a bearing surface. The rocker arm stud includes a threaded shank and an integral head, with the head having tool engaging means recessed in the top surface thereof and also having an integral bearing surface in engagement with the bearing surface of the rocker arm. Threaded means are provided in the cylinder head for threadedly receiving the shank of the rocker arm stud and locking means are provided for selectively locking the threaded shank against rotation with respect to the cylinder head.

A feature of the present invention is the provision of an adjustable lash valve train which results in a compact arrangement while still permitting the use of a push rod guide plate held to the cylinder head by the rocker arm stud.

Other features and advantages of the present invention will become apparent from the following description.

DETAILED DESCRIPTION OF THE PREFERRED EMBODIMENT

Figure 1:
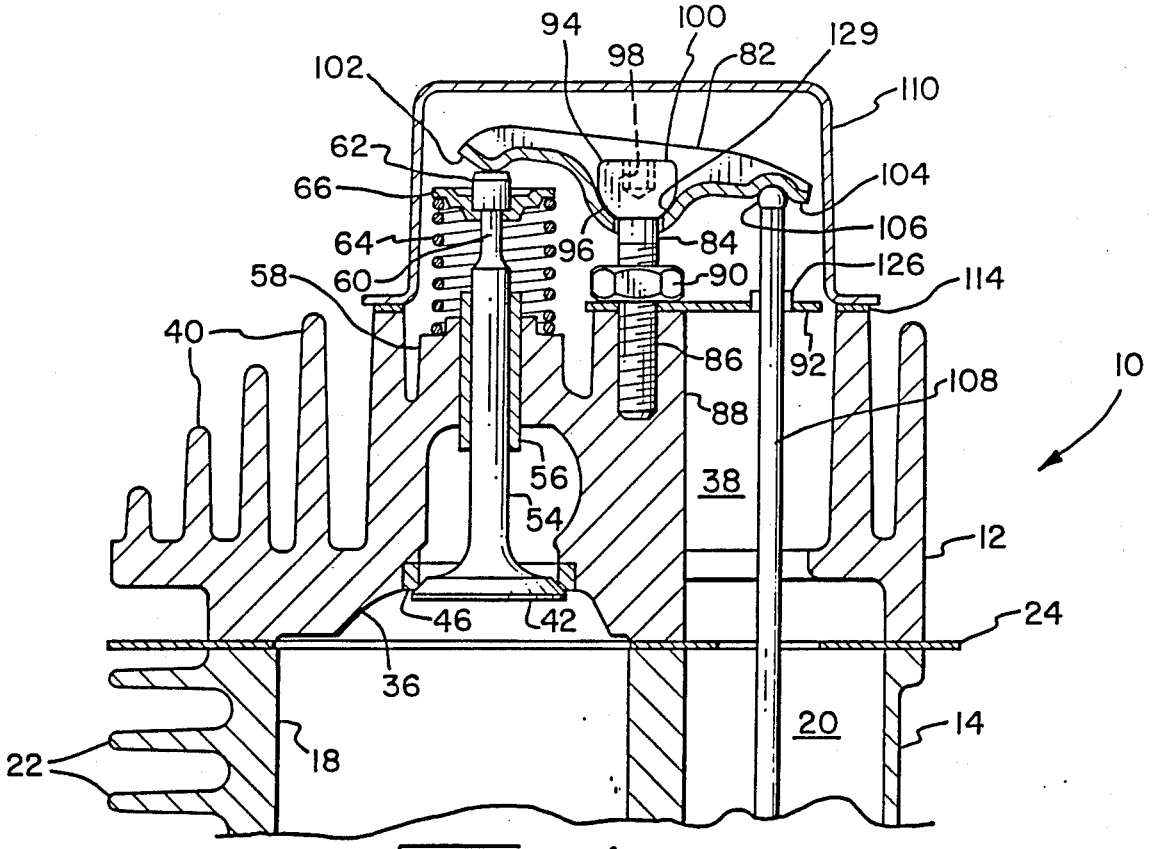
FIG. 1 is a sectional view of the cylinder head area of an overhead valve engine in the plane 1—1 of FIG. 2.
Figure 2:
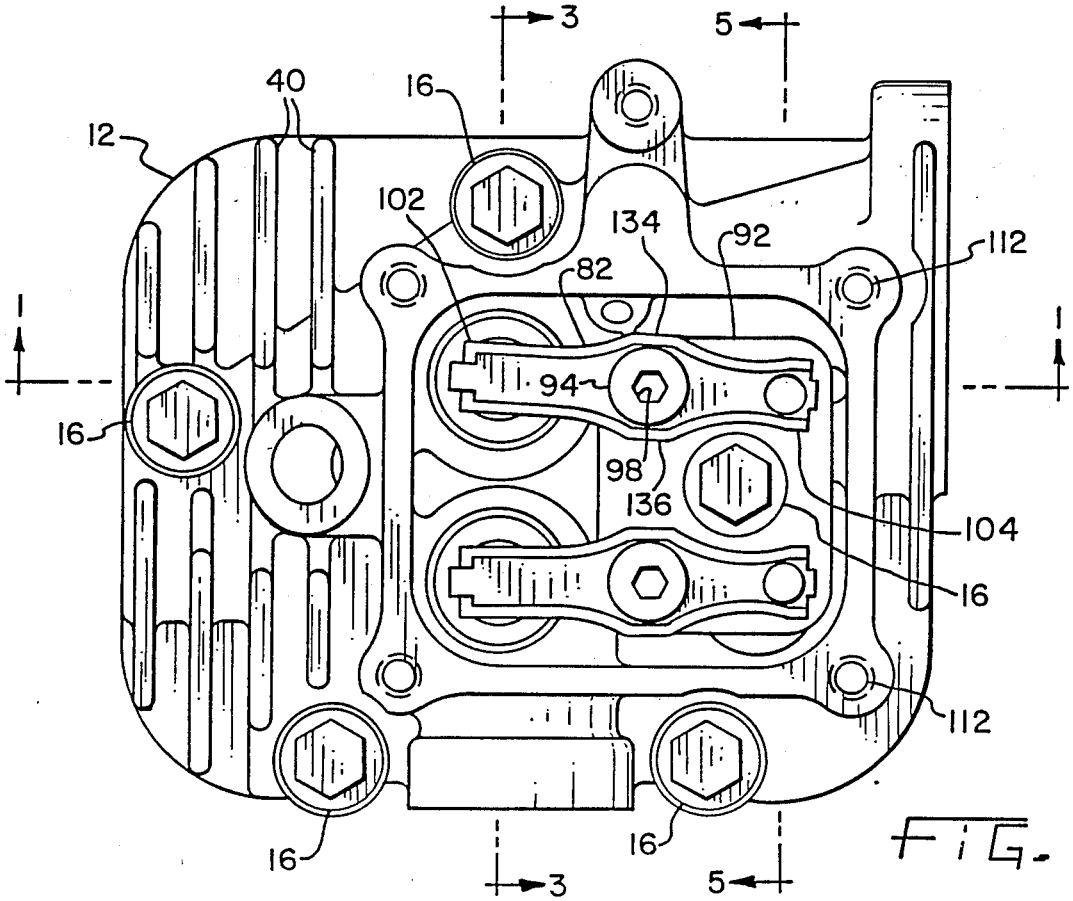
FIG. 2 is a top plan view of the cylinder head of an overhead valve engine with the rocker arm cover removed.
Figure 3:
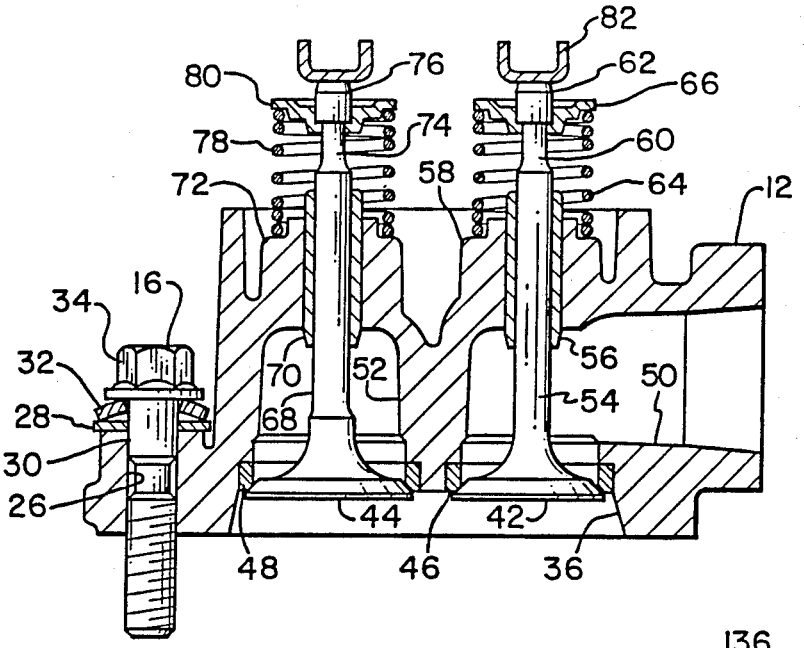
FIG. 3 is a sectional view of the cylinder head of FIG. 2 in the plane 3—3 of FIG. 2.
Figure 4:
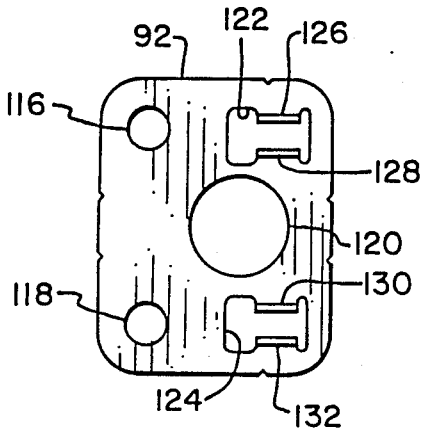
FIG. 4 is a top plan view of the push rod guide plate of the cylinder head of FIG. 2.
Figure 5:
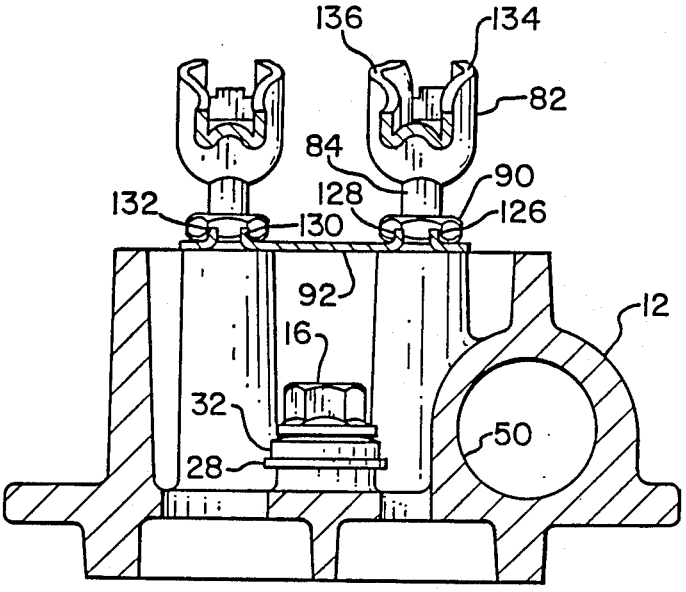
FIG. 5 is a sectional view of the cylinder head of FIG. 2 in the plane 5—5 of FIG. 2.
Figure 6:
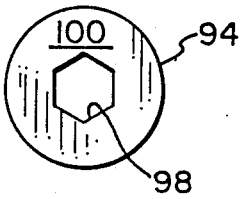
FIG. 6 is a top plan view of a rocker arm stud of the cylinder head of FIG. 2.

Referring in particular to the figures, there is illustrated the cylinder head area of an air cooled overhead valve internal combustion engine 10 including cylinder head 12 which is attached to cylinder portion 14 by five cylinder head bolts 16. Cylinder portion 14 includes cylinder bore 18, push rod cavity 20 and integral cooling fins 22. A metal cylinder head gasket 24 made of a soft aluminum alloy is disposed between cylinder head 12 and cylinder portion 14 to provide a high pressure seal at their interface. Head bolts 16 are received through appropriately sized bores 26 in cylinder head 12 and are threadedly received in a corresponding threaded bore in cylinder portion 14. A flat metal thrust washer 28 is disposed about the shank 30 of head bolt 16 atop cylinder head 12. A dish shaped spring washer 32 is disposed about shank 30 between thrust washer 28 and the underside of head portion 34 of head bolt 16. Head bolt 16 is tightened into cylinder portion 14 sufficiently to partially compress spring washer 32, thereby causing spring washer 32 to maintain substantially constant compressive force on metal head gasket 24 through cylinder head 12 despite temperature induced expansion and contraction of the metal parts adjacent head gasket 24 throughout thermal cycling of the engine. This measure allows metal head gasket 24 to maintain its initial sealing effectiveness over time.

Cylinder head 12 includes a combustion chamber 36 aligned with and in communication with cylinder bore 18, a push rod cavity 38 and integral cooling fins 40. Intake valve 42 and exhaust valve 44, seated on valve seats 46 and 48, respectively, provide for selective communication between combustion chamber 36 and intake port 50 and exhaust port 52, respectively. Intake valve 42 includes valve stem 54 slidingly received in bearing bushing 56 fitted within boss 58 of cylinder head 12. Valve stem 54 includes a reduced neck portion 60 and an end portion 62. Intake valve spring 64 engages boss 58 at one end thereof and valve spring keeper 66 at the other end thereof. Valve spring keeper 66 engages the underside of end portion 62 adjacent neck portion 60 with intake valve spring 64 disposed in compression between boss 58 and valve end portion 62, whereby intake valve 42 is urged against valve seat 46. Likewise, exhaust valve 44 includes valve stem 68 slidingly received within bearing bushing 70 fitted in boss 72 of cylinder head 12. Valve stem 68 includes a reduced neck portion 74 and an end portion 76. Exhaust valve spring 78 engages boss 72 at one end thereof and valve spring keeper 80 at the other end thereof. Valve spring keeper 80 engages the underside of end portion 76 adjacent neck portion 74 with exhaust valve spring 78 disposed in compression between boss 72 and end portion 76, whereby exhaust valve 44 is urged against valve seat 48.

Intake valve rocker arm 82 is pivotally mounted to rocker arm stud 84 which has a threaded shank 86 threadedly received in rocker arm support boss 88 of cylinder head 12. A hex-faced jam nut 90 is threadedly received about shank 86 of rocker arm stud 84 above support boss 88 and can be tightened with respect to support boss 88 to secure rocker arm stud 84 thereto. Sandwiched between support boss 88 and jam nut 90 is push rod guide plate 92, which is described in greater detail below. Rocker arm stud 84 includes an enlarged head portion 94 forged integrally with shank 86. Head portion 94 includes a spherically shaped under surface 96 and a hexagonally shaped recess 98 extending downwardly into head portion 94 coaxially with the axis of shank 86. Recess 98 is open at the top surface 100 of head portion 94. Rocker arm 82 includes an end 102 in engagement with the top of end portion 62 of valve stem 54. Opposite end 104 of rocker arm 82 engages ball shaped end 106 of push rod 108. Push rod 108 extends through push rod guide plate 92 within push rod cavity 38 of cylinder head 12 and into push rod cavity 20 of cylinder portion 14. The end of push rod 108 opposite end 106 engages a valve lifter actuated by a cam on a cam shaft (not shown). A rocker arm cover 110 is secured to cylinder head 12 by threaded bolts received in holes 112 and sealed thereto by rocker arm cover gasket 114.

Push rod guide plate 92 includes rocker arm stud holes 116 and 118 through which the shank of the intake valve rocker arm stud 84 and the exhaust valve rocker arm stud, respectively, are received. Guide plate 92 further includes a round aperture 120 of sufficient size to avoid interference with head bolt 16 disposed therein. A pair of push rod apertures 122 and 124 are provided in guide plate 92 and positioned for receiving push rod 108 corresponding to intake valve 42 and the push rod corresponding to exhaust valve 44, respectively. Extending inwardly into aperture 122 in the plane of guide plate 92 and extending upwardly from the plan of guide plate 92 are push rod guide tabs 126 and 128. Likewise, similarly shaped push rod guide tabs 130 and 132 are associated with aperture 124. Each pair of guide tabs 126 and 128, and 130 and 132 are disposed on either side of a respective push rod. In this orientation, lateral movement of the push rods perpendicular to the rocking plane of the rocker arms is restricted while lateral movement of the push rods in the rocking plane of the rocker arms incidental to the rocking motion of the rocker arms is permitted. Apertures 122 and 124 are sized large enough to receive therethrough the ball shaped end of the push rods during assembly. However, the space between each respective pair of guide tabs 126 and 128, and 130 and 132 is such that the guide tabs are closely adjacent the push rods after assembly.

During operation of engine 10, push rod 108 actuated by the cam shaft reciprocates linearly. Rocker arm 82, which has a spherical bearing surface 129 in engagement with spherically shaped undersurface 96 of rocker arm stud 84, pivots in a rocking plane generally defined by push rod 108 and valve stem 54. The reciprocal motion of push rod 108 is thereby transmitted to end portion 62 of valve 42 such that valve spring 64 is cyclically compressed and valve stem 54 reciprocates within bearing bushing 56.

When valve 42 is firmly seated against valve seat 46 and push rod 108 is disposed in its downwardmost position, it is desirable that there be a slight clearance between end 102 of rocker arm 82 and end portion 62 of valve 42. This clearance, known as valve lash, can be readily adjusted by first loosening jam nut 90 with an open end wrench, and then turning rocker arm stud 84 into or out of rocker arm support boss 88 as necessary by use of an Allen wrench inserted into hexagonally shaped recess 98 in the enlarged head portion 94. The height of the pivot point of rocker arm 82 is thereby adjusted. Once the appropriate valve lash has been achieved, jam nut 90 is again tightened against guide plate 92 on support boss 88 while rocker arm stud 84 is prevented from turning by means of the Allen wrench held within recess 98.

Guide plate 92 is maintained in proper alignment with the push rods by jam nut 90 and also by a second similar jam nut on the exhaust valve rocker arm stud. Since the valve lash of the two valves is adjusted one at a time, guide plate 92 remains securely affixed to cylinder head 12 by at least one jam nut at all times during valve lash adjustment. Consequently, the valve lash of the two valves can be successively adjusted without disturbing the alignment of guide plate 92.

By utilizing a hex shaped recess in the head portion of rocker arm stud 84, it is not necessary to provide clearance for a wrench between head portion 94 and the sidewalls 134 and 136 of rocker arm 82. Sidewalls 134 and 136 need only be spaced sufficiently to clear the diameter of head portion 94. Consequently, the width of rocker arm 82 is reduced relative to prior art rocker arms, enabling a lighter and more compact valve train arrangement. Furthermore, since the bearing surface of the rocker arm stud 84 is integral with the stud, a separate spherical bearing washer and upper lock nut are eliminated which results in a lower height profile of the rocker arm stud and consequently the overall height of the cylinder head can be reduced.

Figure 7:
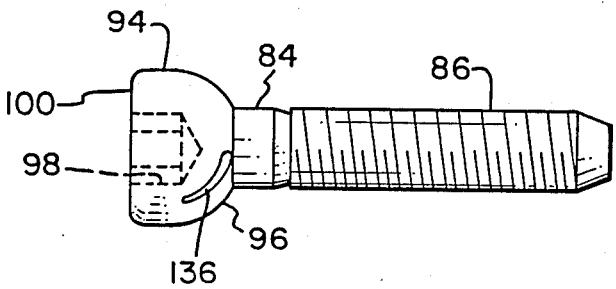
FIG. 7 is a side view of the rocker arm stud of FIG. 6.

Referring in particular to FIG. 7, an oil groove 136 is shown in the spherically shaped undersurface 96 of head portion 94 to facilitate lubrication between bearing surface 96 and bearing surface 129 of rocker arm 82.

While the structure and adjustment of the valve train of engine 10 has been discussed in detail primarily with respect to intake valve 42, it is to be understood that the rocker arm stud, rocker arm, push rod, and valve mechanism associated with the exhaust valve are substantially similar.

This invention has been described with reference to a preferred embodiment, however, it will be understood by those of ordinary skill in the art that the embodiment described herein is capable of modification. This application is therefore intended to cover any variations, uses or adaptations of the invention, following the general principles thereof and including such departures from the present disclosure as come within known or customary practice in the art to which this invention pertains and fall within the limits of the appended claims.

What is claimed is:

1. In combination with an overhead valve internal combustion engine having a cylinder head, a valve reciprocally mounted in said cylinder head, and a push rod, an adjustable lash valve train comprising:

a rocker arm disposed for transmitting motion of said push rod to said valve, said rocker arm including a bearing surface;

a rocker arm stud having a threaded shank and an integral head having a top surface, the head having tool-engaging means recessed in the top surface thereof for engaging a tool suitable for rotating said rocker arm stud, the head having an integral bearing surface in engagement with the bearing surface of said rocker arm;

threaded means in said cylinder head for threadedly receiving the threaded shank of said rocker arm stud;

a push rod guide plate disposed on said cylinder head adjacent said rocker arm stud; and locking means for selectively locking said push rod guide plate against movement with respect to said cylinder head and for locking the threaded shank against rotation with respect to said threaded means in said cylinder head.

2. The engine of claim 1, in which the bearing surface of the head of said rocker arm stud is spherically shaped.

3. The engine of claim 1, in which the tool engaging means of the head of said rocker arm stud includes a multi-sided recess substantially aligned with the longitudinal axis of the shank of said rocker arm stud.

4. The engine of claim 3, in which the multi-sided recess is hexagonal.

5. The engine of claim 1, in which said locking means includes a nut threadedly received about the threaded shank of said rocker arm stud between said push rod guide plate and said rocker arm.

6. The engine of claim 1, in which said rocker arm includes an aperture through which the shank of said rocker arm stud is received, the bearing surface of said rocker arm being located adjacent the aperture, the bearing surface of said rocker arm stud being spherically shaped and located on an undersurface of the head, said push rod guide plate including a pair of guide tabs disposed on either side of said push rod.

7. The engine of claim 6, in which the tool engaging means of the head of said rocker arm stud includes a multi-sided recess substantially aligned with the longitudinal axis of the shank of said rocker arm stud.

8. The engine of claim 7, in which said locking means includes a nut threadedly received about the threaded shank of said rocker arm stud between said push rod guide plate and said rocker arm.

9. The engine of claim 8, in which the multi-sided recess is hexagonal.

10. A valve train for an internal combustion engine having a cylinder head, comprising:

a rocker arm including a bearing surface; integral head, the head having an integral bearing surface in engagement with the bearing surface of said rocker arm;

threaded means in said cylinder head for threadedly receiving the threaded shank of said rocker arm stud;

a push rod guide plate disposed on said cylinder head adjacent said rocker arm stud; and locking means for selectively locking said push rod guide plate against movement with respect to said cylinder head and for locking the threaded shank against rotation with respect to said threaded means in said cylinder head.

11. The valve train of claim 10, in which said locking means includes a nut threadedly received about the threaded shank of said rocker arm stud in engagement with said push rod guide plate.

12. The valve train of claim 11, in which the head of said rocker arm stud includes a top surface having tool-engaging means recessed therein for engaging a tool suitable for rotating said rocker arm stud.

* * * * *

UNITED STATES PATENT AND TRADEMARK OFFICE

CERTIFICATE OF CORRECTION

PATENT NO. : 4,856,467

DATED : August 15, 1989

INVENTOR(S) : Peter G. Kronich

It is certified that error appears in the above-identified patent and that said Letters Patent is hereby corrected as shown below:

Claim 10, Col. 6, line 44, after "surface;" insert --a rocker arm stud having a threaded shank and an--.

Signed and Sealed this

Fifth Day of June, 1990

*Attest:*

HARRY F. MANBECK, JR.

*Attesting Officer*

*Commissioner of Patents and Trademarks*